United States Patent [19]

Day

[11] Patent Number: 4,989,335

[45] Date of Patent: Feb. 5, 1991

[54] WALLPAPER KNIFE GUIDE

[76] Inventor: Nathan M. Day, 14638 Wexhall Ter., Burtonsville, Md. 20866

[21] Appl. No.: 464,217

[22] Filed: Jan. 12, 1990

[51] Int. Cl.[5] ..... B43L 7/00

[52] U.S. Cl. ..... 33/403; 33/32.2; 33/481; 33/492; 33/526

[58] Field of Search ..... 33/403, 32.1, 32.2, 33/32.3, 41.1, 41.5, 429, 481, 483, 485, 492, 526, 527; 7/103, 105; 30/286, 289, 291

[56] References Cited

U.S. PATENT DOCUMENTS

| | | | |
|---|---|---|---|
| 1,451,444 | 4/1923 | Lupton | 33/485 X |
| 2,414,408 | 1/1947 | Galazin | 30/289 |
| 3,509,633 | 5/1970 | Fernandes | 33/562 |
| 3,862,494 | 1/1975 | Andersson | 30/289 |
| 4,349,966 | 9/1982 | Marino | 33/489 |

FOREIGN PATENT DOCUMENTS

| | | | |
|---|---|---|---|
| 511911 | 6/1952 | Belgium | 33/429 |
| 1027861 | 2/1953 | France | 33/492 |
| 2126939 | 4/1984 | United Kingdom | 33/403 |

*Primary Examiner*—Harry N. Haroian
*Attorney, Agent, or Firm*—Edward A. Pennington

[57] ABSTRACT

A guide for guiding wallpaper knife includes a planar member with a right-angled lip formed at a forward end portion of the planar member. The right-angled lip and the planar member form a press for pushing an overlapping sheet of wallpaper into a corner, while a flat linear edge of the right-angled lip provides a guide surface for guiding the wallpaper knife along a linear path substantially parallel to the corner of a room.

5 Claims, 1 Drawing Sheet

WALLPAPER KNIFE GUIDE

BACKGROUND OF THE INVENTION

1. Field of the Invention

The present invention relates generally to wallpapering, and more specifically, to a knife guide for cutting wallpaper at any vertical inside corner of a room.

2. Description of the Related Art

Wallpapering an inside corner of a room presents a technically difficult problem in that it is visually desirable to have a sharp right angle with the pattern or print of the wallpaper matching as it turns the corner. Unfortunately, it is very difficult to construct a perfect corner. Thus, where a perfect corner would have intersecting planes of two right-angled walls forming a perfectly straight vertical line, in reality, the intersecting planes form generally non-linear and multi-planar lines. This makes it nearly impossible for the artisan to go around the corner with a single sheet of paper finishing one wall and starting down the next with a perfectly plumb vertical edge. It is also nearly impossible to have two side edges of paper meet of butt together at the corner as one would on the flat wall.

A second reason for "breaking" and restarting at every inside corner is that some materials shrink upon drying. This ofter ruins the tight bond at the inside corner and the sharp, crisp look of a 90-degree angle.

Although overlapping a side edge portion of one sheet over the side edge portion of the other sheet is a known technique for compensating for imperfections in the corner, creating the necessary overlap which looks best is difficult. It should be very small, e.g. ⅛" at most, just enough to hide a seam at the very corner and giving the illusion of the pieces being butted together.

Another great benefit of making the overlap small occurs with printed papers that require the pattern always be matched. With the small overlap, the cut piece can be matched at eye level and then made vertically plumb overall. The illusion created is that it is a perfect match at the corner and no material is lost or wasted.

Various known devices have been used in the past to guide a wallpaper knife. For instance, U.S. Pat. No. 3,500,540 has a right-angled guide for holding a wallpaper knife in the corner of the guide in order to guide the knife down the corner of a room. However, the guide requires a perfect corner in order to cut wallpaper in a straight line at the corner. Therefore, U.S. Pat. No. 3,500,540 does not address the problems in wallpapering created by imperfect room corners.

U.S. Pat. No. 3,875,664 describes a scribing tool for cutting tile which must be cut next to a wall. However, since tilts are rigid, they do not experience the same problems associated with cutting wallpaper sheets.

U.S. Pat. No. 4,330,939 describes a template for trimming covered linoleum.

U.S. Pat. No. 3,724,010 describes a device which resembles a putty knife having a knife blade mounted in a forward corner edge thereof.

U.S. Pat. No. 4,589,207 describes a wallpaper trimmer which does not have any specific application for overlapping two sheets of wallpaper U.S. Pat. No. 4,095,340 teaches a device for trimming overlapping edges to form a butt-seam.

U.S. Pat. No. 4,667,409 describes a wallpaper trimmer for cutting wall coverings on outer wall corners.

The above-mentioned patents do not address problems created by inperfect wall corners.

SUMMARY OF THE INVENTION

An object of the present invention is to provide a guide which facilitates the straight and even cutting of a piece of wallcovering just after it turns any vertical inside corner. This provides for an easy and attractive overlap in the corner.

Another object of the present invention is to provide a guide which is capable of shaping any wallcovering at the corner to facilitate an overlap despite crookedness or imperfection.

Another object of the present invention is that by facilitating a small overlap at all inside corners, the same piece can be used on the next wall. Thus patterns will still appear perfectly matched, wasted will be minumized, with expense and time being saved.

Another object of the present invention is to provide a wallpaper knife guide which is easy to operate and inexpensive to manufacture.

These and other objects of the invention are achieved by providing a guide for guiding a wallpaper knife in proximity to a room corner to cut one of two adjacent sheets of wallpaper having a side edge portion which overlaps a side edge portion of the other sheet, the guide including a planar member having forward and rearward portions, a right-angled lip formed along the forward portion of the planar member, the planar member and the lip forming a right-angled press for pushing the side edge portion of the overlapping sheet tightly into the room corner; and a handle provided on the rearward portion of the planar member, the lip having a linear upper outer edge for guiding a wallpaper knife.

These objects, together with other objects and advantages which will be subsequently apparent reside in the details of construction and operation of the apparatus as more fully hereinafter described and claimed, reference being had to the accompanying drawings forming a part hereof, wherein like reference numerals refer to like parts throughout.

DETAILED DESCRIPTION OF THE PREFERRED EMBODIMENTS

Figure 1:
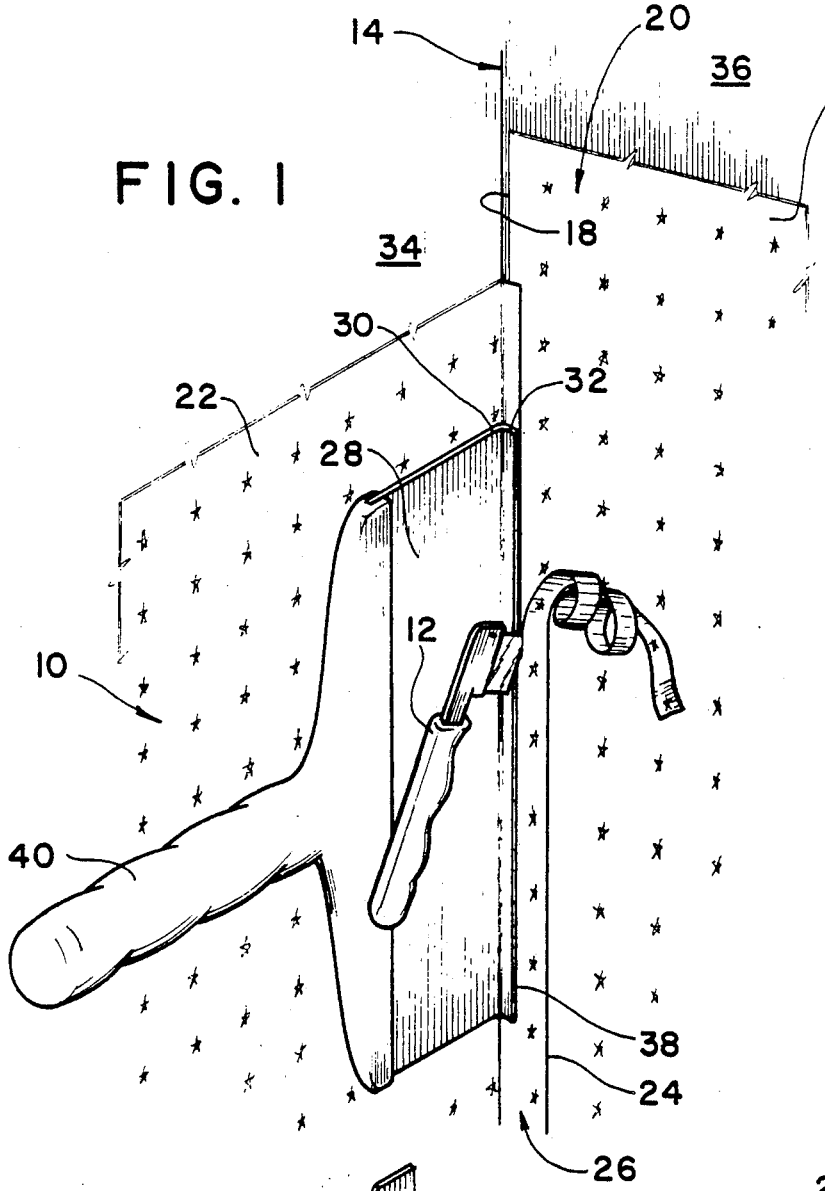
FIG. 1 is a perspective view of a first preferred embodiment of the present invention, shown guiding a wallpaper knife in a room corner.

Referring to FIG. 1, a guide 10 is used for guiding a wallpaper knife 12. The room corner 14 is illustrated as a vertical line which is understood to be nonperfectly linear. Thus, a need exists to have one wallpaper sheet 16 substantially abutting the corner 14 with a leading edge 18 of an edge portion 20. Wallpaper sheet 22 has a leading edge 24 of a forward portion 26. The forward portion 26 overlaps the forward portion 20 of wallpaper sheet 16.

The wallpaper knife guide 10 includes a planar member 28 which has a forward portion 30 and a right-angled lip 32 which extends upwardly and outwardly from the planar member 30. The planar member 30 and the right-angled lip 32 approximately coincide angularly with the angled orientation of wall surface 34 of a first wall and wall surface 36 of a second, adjacent wall. Thus, when the guide 10 is pressed into the corner 14 the wallpaper sheet 22 is pressed to conform to the adjacent wall surfaces 34 and 36.

After pressing the guide 10 into the corner, a wallpaper knife is placed on a linear upper edge 38 of the right-angled lip 32 and thus provides means for cutting the end portion 26 of the wallpaper sheet 22 along a straight line substantially parallel to the corner 14.

By using two hands, the artisan can use the guide 10 in one of two ways. First, the knife 12 can be held in one hand while holding the guide 10 in the other hand by gripping the handle 40. Then, both the guide 10 and knife 12 can be moved along the corner 14 at the same time from ceiling to floor. Secondly, the guide 10 can be held in place while moving the knife 12 along the edge 38. The forward portion 30 of the planar member 28 is preferably about nine inches long, and thus provides a substantial length over which the knife 12 can be guided.

Figure 2:
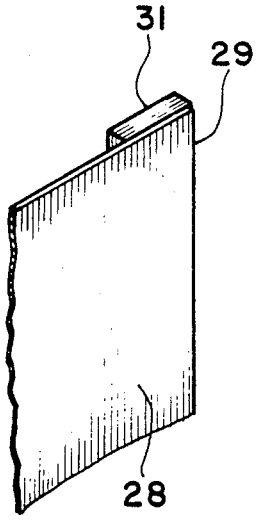
FIG. 2 is an enlarged, partial perspective view of a second preferred embodiment of the present invention.

In FIG. 1, the right-angled lip 32 is integrally formed with the planar member by bending. FIG. 2 illustrates an alternative embodiment in which the planar member 28 has a flat linear edge 29 which guides the knife 12, while a rectangular rubber pad 31 is connected to an inner surface of the planar member 28 to press the end portion 26 of wallpaper sheet 22 into the corner 14.

Figure 3:
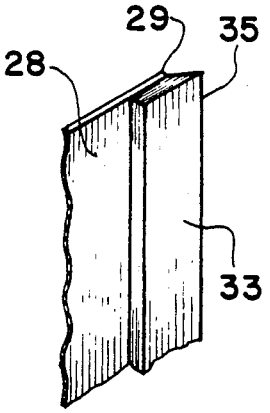
FIG. 3 is an enlarged, partial perspective view of a third preferred embodiment of the present invention.

The embodiment of FIG. 3 has a similar planar member 28 and flat linear edge 29, but has a metal plate 33 connected to the end portion of the planar member 28 so that a forward edge 35 of the metal plate 33 provides the guiding edge for the knife 12.

Figure 4:
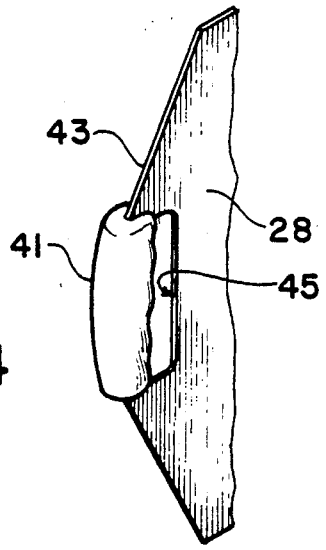
FIG. 4 is a partial perspective view of an alternative handle which can be used in any one of the three preferred embodiments.

FIG. 4 shows an alternative handle 41 which is molded around a rearward edge 43 of the planar member 28. An opening 45 is provided in the rearward portion of the planar member 28 adjacent the handle 41 to provide a grip.

The many features and advantages of the present invention are apparent from the detailed specification, and thus, it is intended by the appended claims to cover all such features and advantages of the wallpaper knife guide which fall within the true spirit and scope of the invention. Further, since numerous modifications and changes will readily occur to those skilled in the art based upon the disclosure herein, it is not desired to limit the invention to the exact construction and operation illustrated and described. Accordingly, all suitable modifications and equivalents may be resorted to falling within the scope and the spirit of the invention.

What is claimed is:

1. A guide for guiding a wallpaper knife in proximity to a room corner to cut one of two adjacent sheets of wallpaper, each having a side edge portion, and the sheet being cut having its side edge portion narrowly overlapping the side edge portion of the other sheet, the guide comprising:

a planar member having forward and rearward portions;

a right-angled lip formed on the forward portion of the planar member, the planar member and the right-angled lip forming a press for pressing the overlapping side edge portion of the sheet into the corner; and a handle provided on the rearward portion of the planar member for holding and moving the guide along the corner, the right-angled lip having a linear edge for guiding the wallpaper knife along a linear path substantially parallel to the corner, wherein the right-angled lip comprises a metal bar formed on the forward end portion of the planar member.

2. A guide according to claim 1, wherein the handle comprises an appendage extending rearwardly from the rearward portion of the planar member.

3. A guide according to claim 1, wherein the handle comprises a grip molded to the rearward portion of the planar member adjacent an opening formed in the rearward portion of the planar member.

4. A guide according to claim 1, wherein the overlap made possible is $\frac{1}{8}$ inch or less.

5. A guide for guiding a wallpaper knife in proximity to a room corner to cut one of two adjacent sheets of wallpaper, each having a side edge portion, and the sheet being cut having its side edge portion narrowly overlapping the side edge portion of the other sheet, the guide comprising:

a planar member having forward and rearward portions;

a right-angled lip formed on the forward portion of the planar member, the planar member and the right-angled lip forming a press for pressing the overlapping side edge portion of the sheet into the corner; and a handle provided on the rearward portion of the planar member for holding and moving the guide along the corner, the right-angled lip having a linear edge for guiding the wallpaper knife along a linear path substantially parallel to the corner, wherein the right-angled lip comprises a forward edge of the planar member and a rectangular rubber pad connected to the forward end portion of the planar member on a surface thereof which faces inwardly, the forward edge of the planar member and a forward surface of the rubber pad being coplanar.

* * * * *